United States Patent [19]

Uozumi et al.

[11] 4,215,837

[45] Aug. 5, 1980

[54] TRACK SWITCHING MEANS FOR GUIDEWAY VEHICLES

[75] Inventors: Yukio Uozumi, Kobe; Fumitaka Mizoshita, Kakogawa, both of Japan

[73] Assignee: Kawasaki Jukogyo Kabushiki Kaisha, Kobe, Japan

[21] Appl. No.: 946,034

[22] Filed: Sep. 26, 1978

[30] Foreign Application Priority Data

Sep. 30, 1977 [JP] Japan ..... 52-116816

[51] Int. Cl.[2] ..... E01B 7/08

[52] U.S. Cl. ..... 246/433; 104/130

[58] Field of Search ..... 246/433, 422, 333; 104/130, 131, 100, 247

[56] References Cited

U.S. PATENT DOCUMENTS

| | | | |
|---|---|---|---|
| 433,934 | 8/1890 | Duggan | 246/433 |
| 3,812,789 | 5/1974 | Nelson | 104/130 |

*Primary Examiner*—Trygve M. Blix
*Assistant Examiner*—Reinhard J. Eisenzopf
*Attorney, Agent, or Firm*—Fleit & Jacobson

[57] ABSTRACT

Switching mechanism for tracks of a guideway vehicle system including a pair of movable guide rail segments which are mounted on a pair of transversely extending crankshafts so that the guide rail segments can be alternately moved into an operative position. The crankshafts are connected by a linkage so that they rotate simultaneously.

6 Claims, 14 Drawing Figures

TRACK SWITCHING MEANS FOR GUIDEWAY VEHICLES

The present invention relates to guideway vehicles and more particularly to track means for such vehicles. More specifically, the present invention pertains to switching means for such track means.

Hithertofore, there has been developed a guideway vehicle including load bearing wheels adapted to run on running surface means and guide wheels adapted to roll along guide rails provided at the opposite sides of the running surface means. In this type of vehicle system, since the guide rails are located generally at a level which is higher than the level of the running surface means, switching means for the track includes retractable guide rail segments which are selectively moved to projected or operative positions to provide continuous guide surfaces. In this type of switching means, it has been considered as being important to provide a simple and reliable mechanism for operating the switching means with an operating effort which is as small as possible and for locking the switching means in its operative positions.

It is therefore an object of the present invention to provide switching means for a guideway vehicle system which is simple in structure and can operate with a decreased power from a centralized power source.

Another object of the present invention is to provide switching means which includes a simple but reliable locking mechanism.

A further object of the present invention is to provide switching means which includes means for eliminating any effect of thermal expansion and ensuring quick and reliable operation.

Still further object of the present invention is to provide simple and reliable switching means which is free from any interference between movable parts.

According to the present invention, the above and other objects can be accomplished by track means for guideway vehicles comprising running surface means adapted for having load bearing wheels of the vehicle to run thereon, and guide rail means provided at the opposite sides of and extending along the running surface means, said running surface means including a first running surface section and at least second and third running surface sections which are separated from each other and connected with said first section through an intermediate running surface section, said guide rail means including first, second and third stationary guide rail sections respectively at the opposite sides of the first, second and third running surface sections, and switching means provided in the intermediate running surface section and including at least first and second guide rail segments for connecting said first stationary guide rail section respectively with said second and third stationary guide rail sections, said first and second guide rail segments being retractable beneath the intermediate running surface section, crankshaft means extending transversely with respect to said first and second guide rail segments and having crankarms extending in diametrically opposite directions, one of said crankarms being connected with said first guide rail segment and the other with said second guide rail segment, drive means for rotating said crankshaft means so that said first and second guide rail segments are alternately brought into operative positions wherein they project beyond the intermediate running surface section so as to alternately provide guide surfaces between said first stationary guide rail section and said second and third stationary guide rail sections.

The crankshaft means may comprise a pair of parallel crankshafts which are connected by means of a linkage so that they rotate simultaneously. In such an arrangement, one of the crankshafts may be mounted on the stationary part of the track for lateral movement with respect to the other crankshaft so that any effect of thermal expansion may be compensated for.

The above and other objects and features of the present invention will become apparent from the following descriptions of a preferred embodiment taking reference to the accompanying drawings, in which.

Figure 13:
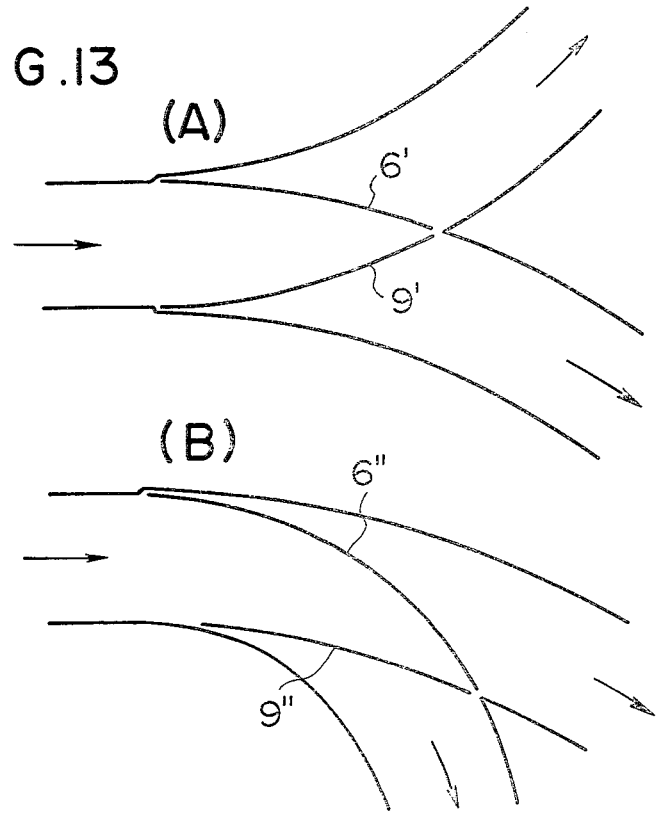

FIGS. 13 A and B show different examples of switching arrangements to which the present invention can be applied.

Figure 1:
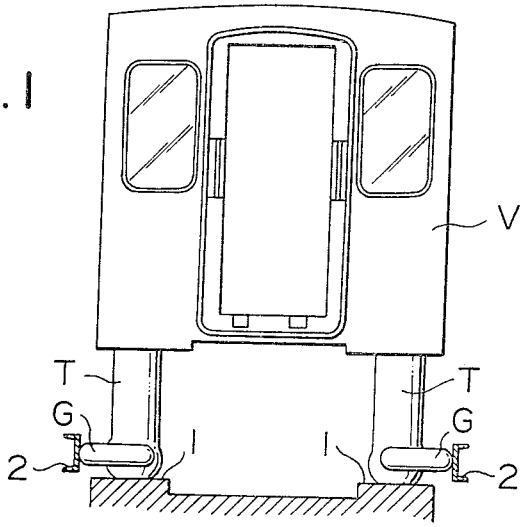
FIG. 1 is an end view of a guideway vehicle and a track therefor to which the switching device of the present invention can be applied.

Referring to the drawings, particularly to FIG. 1, the guideway vehicle shown therein comprises a body V having load bearing wheels T and guide wheels G. The track for the guideway vehicle therefore comprises running surfaces 1 on which the wheels T are adapted to roll and a pair of guide rails 2 which are located at the opposite sides of the running surfaces 1. The guide rails 2 have inward or guide surfaces on which the guide wheels G are adapted to roll.

Figure 2:
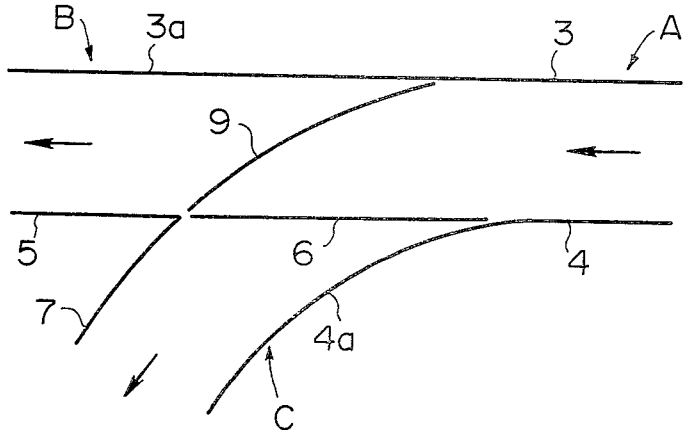
FIG. 2 is a plan view diagrammatically showing a typical example of switching track.
Figure 5:
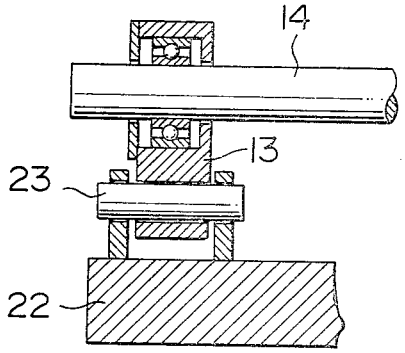
FIG. 5 is a sectional view showing a pivotable support at one end of one of the crankshafts.

Referring now to FIG. 2, there is shown a typical example of a track switching mechanism. For the purpose of clarity, there are shown in FIG. 2 only guide rail arrangements which include stationary guide rails 3 and 4 arranged in parallel with each other to constitute a first guide rail section A. The guide rails 3 and 4 are respectively continuous with stationary guide rails 3*a* and 4*a* which are diverged one from the other. A stationary guide rail 5 is provided in parallel with the guide rail 3*a* to constitute a second guide rail section B. Similarly, a stationary guide rail 7 is provided in parallel with the guide rail 4*a* to constitute a third guide rail section C. A switching mechanism is provided by means of movable guide rail elements 6 and 9 which are adapted to extend respectively between the rails 4 and 5 between 3 and 7. The movable guide rails 6 and 9 are movable in vertical direction so that they can be alternately retracted from the level of the running surface.

Figures 3, 4:
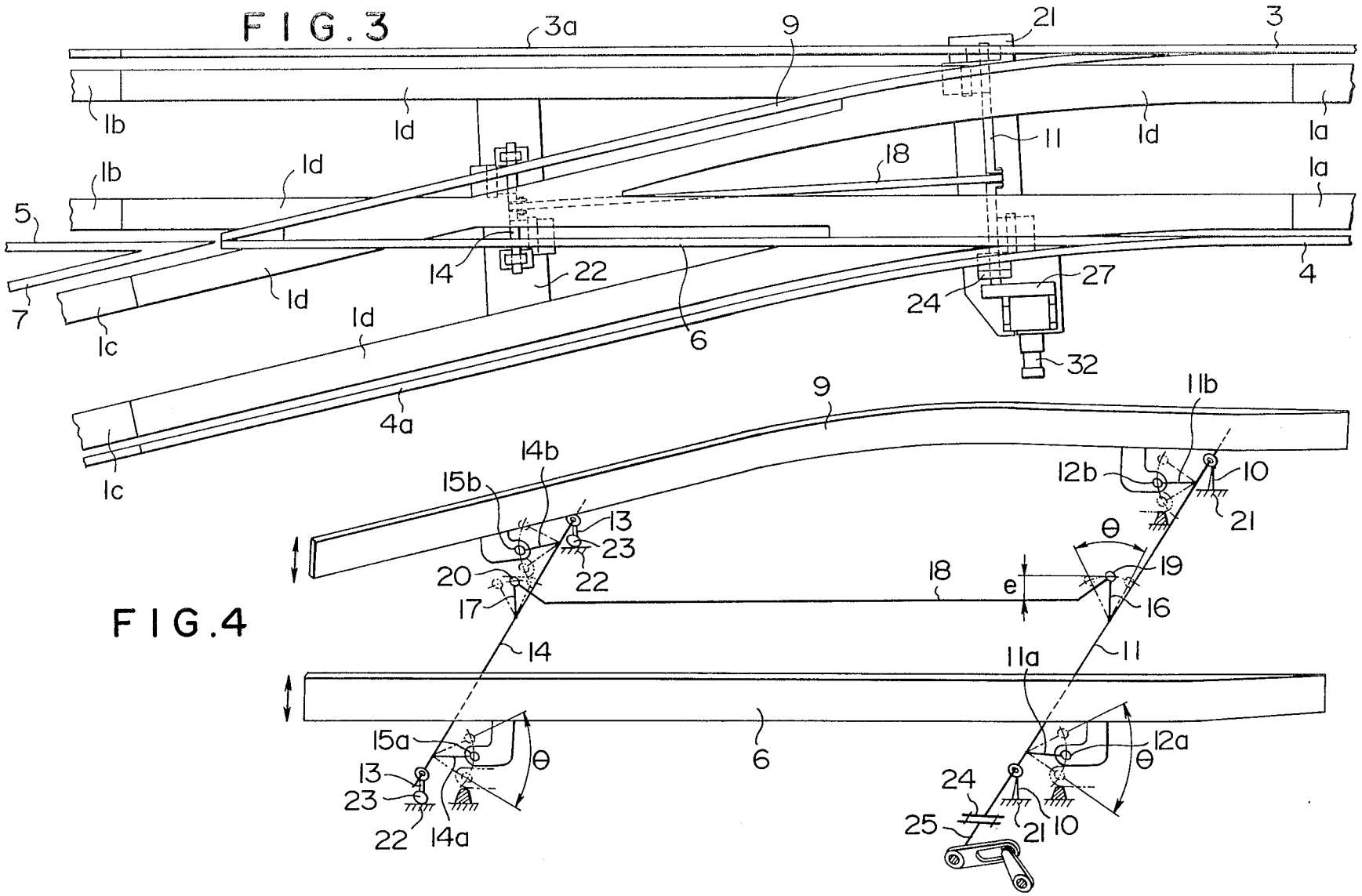
FIG. 3 is a plan view showing a track switching mechanism in accordance with one embodiment of the present invention.
FIG. 4 is a perspective view of the switching mechanism shown in FIG. 3.

Referring now to FIGS. 3 and 4, the movable guide rails 6 and 9 are mounted on a pair of crankshafts 11 and 14 which are in parallel with each other and extending transversely with respect to the guide rails 6 and 9. The crankshaft 11 is rotatably mounted on a base 21 of the track through brackets 10 and has crankarms 11*a* and 11*b* extending in diametrically opposite directions. The guide rails 6 and 9 are connected through pins 12*a* and 12*b* respectively with the crankarms 11*a* and 11*b* so that they are moved in the opposite directions upon rotation of the crankshaft 11.

The crankshaft 14 is rotatably mounted on a base 22 of the track through arms 13 which are swingably mounted on the base 22 by means of pins 23 extending in parallel with respect to the crankshaft 14. The crankshaft 14 has crankarms 14*a* and 14*b* which are extending in diametrically opposite directions and respectively parallel with the crankarms 11*a* and 11*b*. The crankarms 14*a* and 14*b* are connected through pins 15*a* and 15*b* respectively with the guide rails 6 and 9. It should be noted that the crankarms 11*a*, 11*b*, and 14*a* and 14*b* have substantially the same lengths and the movable guide rails 6 and 9 are of substantially the same weights so that the weights of the guide rails are balanced about the crankshafts 11 and 14. The crankshafts 11 and 14 have crankarms 16 and 17, respectively, which extend perpendicularly to the crankarms 11*a*, 11*b*, 14*a*, 14*b* and connected together by a link 18 through pins 19 and 20, respectively.

In FIG. 3, it will further be noted that a pair of parallel running surfaces 1*a* are provided between the stationary guide rails 3 and 4 to constitute a first running surface section. Between the guide rails 3*a* and 5, there are provided a pair of parallel running surfaces 1*b* to constitute a second running surface section. Similarly, a pair of parallel running surfaces 1*c* are between the guide rails 4*a* and 7 to provide a third running surface section. An intermediate running surface section 1*d* is provided to connect the first section with the second and third sections.

Figure 6:
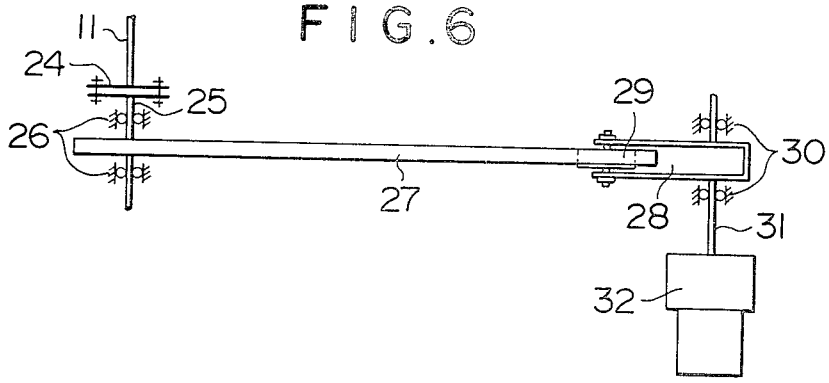
FIG. 6 is a diagrammatical plan view showing one embodiment of the driving mechanism.
Figure 7:
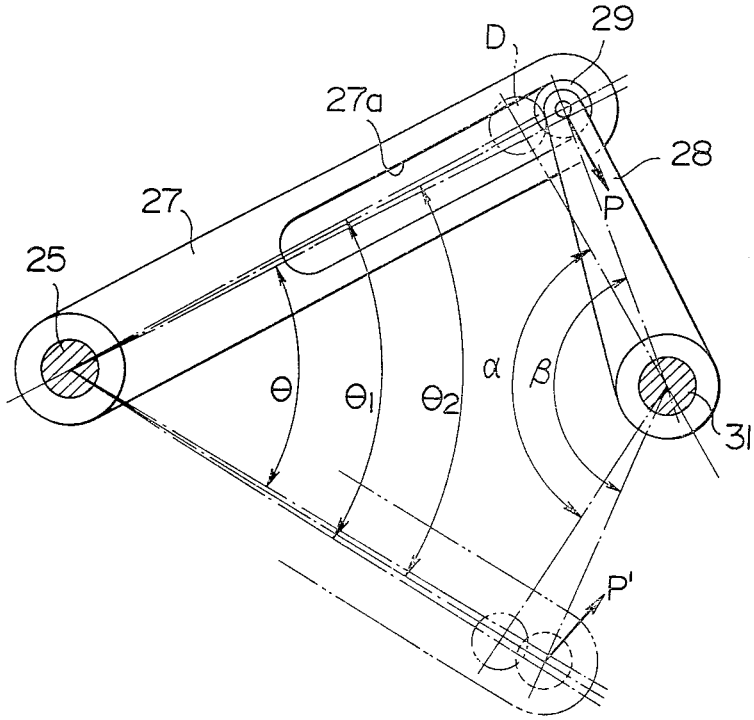
FIG. 7 is an end view showing the driving mechanism.

Referring further to FIG. 4, it should be noted that the crankshaft 11 is connected at one end through a torsionally deflectable coupling 24 with a drive shaft 25 which is, as shown in FIG. 6, supported by means of bearings 26 and has an arm 27 secured thereto. As shown in FIG. 7, the arm 27 is formed with a slot 27*a* which receives a roller 29 rotatably mounted at one end of a driving crankarm 28. The driving crankarm 28 is provided on an output shaft 31 of a driving motor 32, the shaft 31 being mounted through bearings 30. In the arrangement, since the crankshaft 14 is mounted on the base 22 through the swingable arms 13, it is possible to eliminate any effect of thermal expansion.

In the arrangement described above, when it is desired to run the vehicle from the running surfaces 1*a* to the running surfaces 1*b* or vice versa, the motor 32 is actuated to move the crankarm 28 to the position shown by a solid line in FIG. 7. The arm 27 is then rotated counterclockwise as seen in the plane of FIG. 7 so that the crankshaft 11 is rotated in the same direction through the drive shaft 25 and the coupling 24 to a position shown in FIG. 9. The crankarm 11*a* is thus moved upwards and the crankarm 11*b* downwards until the crankarm 11*b* abuts a stopper 33 provided for the purpose.

The rotation of the crankshaft 11 is transmitted through the crankarm 16, the link 18 and the crankarm 17 to the crankshaft 14 to rotate the latter in the same direction. Thus, the crankarm 14*a* is moved upwards and the crankarm 14*b* downwards until the latter abuts a stopper 34 provided for the purpose. The guide rail 6 is therefore lifted to a projected or operative position while the guide rail 9 is retracted below the level of the running surface.

When it is desired to switch the track from the running surfaces 1*b* to the running surfaces 1*c*, the motor 32 is energized in the opposite direction so that the guide rail 9 is lifted to a projected operative position and the guide rail 6 is retracted. The angular strokes of the crankarms 16 and 17 in each cycle of operation are designated in FIG. 9 by reference character $\theta$. The arrangement of the driving mechanism is such that the driving crankarm 28 causes a swinging movement of the arm 27 through an angular stroke of $\theta_1$ which is greater than the angle $\theta$. Such maximum angle $\theta_1$ of swinging movement of the arm 27 is produced when the longitudinal axis of the crankarm 28 is perpendicular to the longitudinal axis of the arm 27 as shown by D in terms of the position of the roller 29 in FIG. 7. This position of the roller 29 may be referred to as the "dead point".

In FIG. 7, it will be noted that the roller 29 is moved to an extreme position beyond such dead point in either direction of swinging movement of the crankarm 28. The angular stroke of the arm 27 between two extreme positions is designated by $\theta_2$ in FIG. 7 and the angle $\theta_2$ is greater than the angle $\theta$ but smaller than the angle $\theta_1$. The angular stroke of the crankarm 28 between the dead points is shown by $\alpha$ and that between the extreme positions by $\beta$.

Since the drive shaft 25 is driven through the angle $\theta_1$ which is larger than the angle $\theta$ which is the maximum stroke of either the crankshaft 11 or 14, a torsional deflection is produced in the coupling 24. Even under the extreme position of the arm 27, there is maintained a certain amount of torsional deflection in the coupling 24. Thus, the crankarms 11*b* and 14*b* are maintained under pressure R on the bases 33 and 34, respectively, and the roller 29 on the crankarm 28 is subjected to a reacion force P applied from the arm 27 at the overcentered extreme position. Therefore, the crankshafts 11 and 14 are locked in position under the reaction forces R and P.

Figure 8:
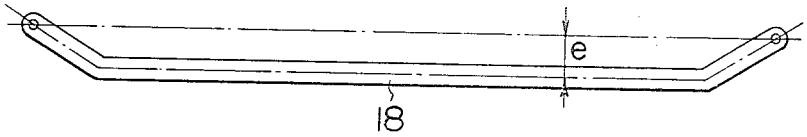
FIG. 8 shows a link for connecting two crankshafts.
Figure 9:
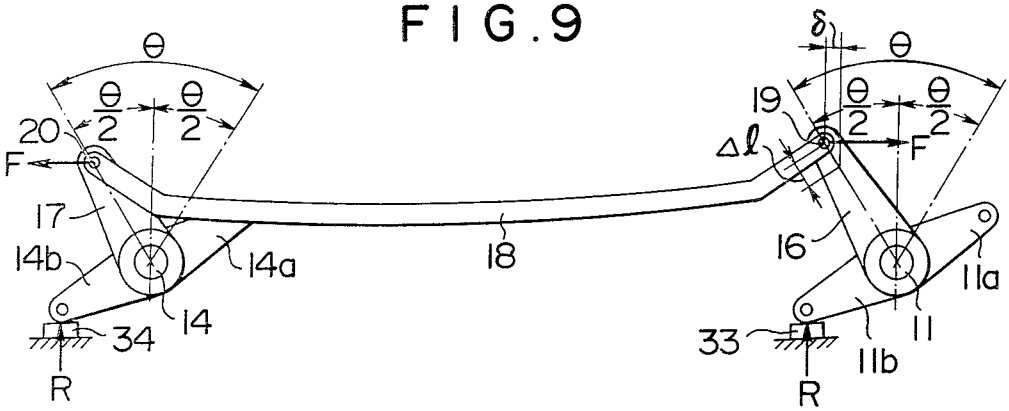
FIG. 9 is an end view showing the connection between the crankshafts.

The connection between the crankshafts 11 and 14 is such that the crankarm 16 on the crankshaft 11 is longer than the crankarm 17 on the crankshaft 14 by a length $\Delta 1$ so that the amount of shift of the pin 19 on the arm 16 is greater than that of the pin 20 on the arm 17 by an amount $\delta$. The link 18 is longitudinally deformed by the same amount. Since the link 18 is bent in such a manner the longitudinal axis along the substantial part thereof is offset by an amount e from a line through the opposite ends as shown in FIG. 8, it can readily be deformed and transmit a force F as shown in FIG. 9.

Figure 10:
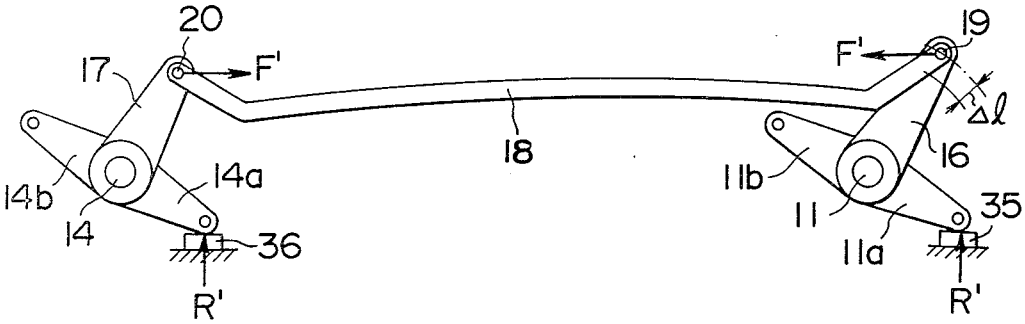
FIG. 10 is an end view similar to FIG. 9 but showing the connecting linkage in a different position.

When the motor 32 is energized in the direction to move the arm 27 to the position shown by dotted lines in FIG. 7, the crankarms 11 and 14 are rotated in the opposite direction until the crankarms 11*a* and 14*a* abut stoppers 35 and 36 as shown in FIG. 10. In this instance, the crankshaft 11 is locked in position under a reaction force R′ applied to the crankarm 11*a* from the stopper 35 and a force P′ produced between the arm 27 and the roller 29 on the crankarm 28. The crankshaft 14 is also locked in position under the reaction force R′ applied from the stopper 36 to the crankarm 14*a* and the force F' applied from the link 18 to the crankarm 17.

Figure 11:
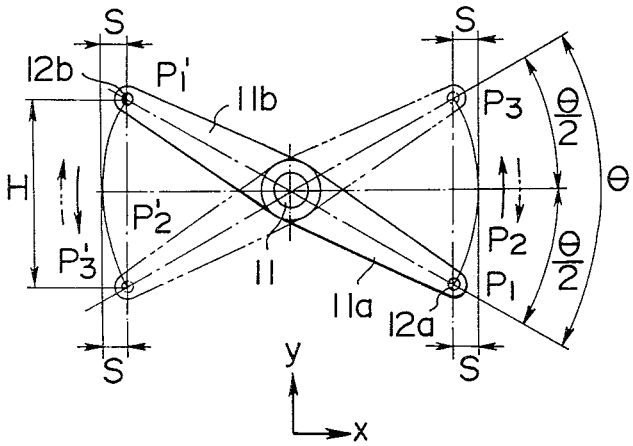
FIG. 11 is an end view for explaining movements of crankarms.

FIG. 11 shows movements of the pins 12*a* and 12*b* on the crankarms 11*a* and 12*b* in response to the rotation of the crankshaft 11. The pins 12*a* and 12*b* move in vertical or Y direction by a distance H when the crankshaft 11 is rotated through the angle $\theta$ but they reciprocate in horizontal or X direction through a stroke S. It should therefore be noted that when the crankshafts 11 and 14 are rotated through the angle $\theta$, the guide rails 6 and 9 are reciprocated through the stroke S in the direction perpendicular to the crankshafts. The directions of the reciprocating movements of the guide rails 6 and 9 are opposite with each other.

Figure 12:
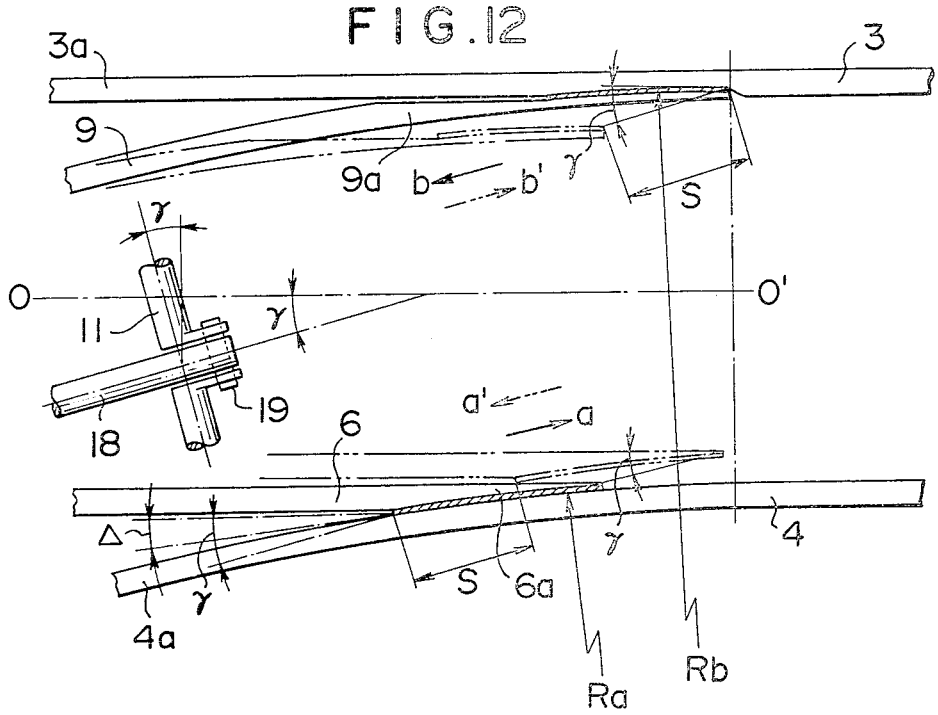
FIG. 12 is a fragmentary plan view showing the movement of switching guide rails with respect to stationary guide rails.

Referring to FIG. 12, there are shown end portions of the movable guide rails 6 and 9 where they are connected with the stationary guide rails 4 and 3, respectively. Although both of the guide rails 6 and 9 are shown in similar ways by solid lines, it should be noted that only one of them is in the operative position but the other is in retracted or lowered position. The guide rails 6 and 9 have tapered ends 6*a* and 9*a*, respectively, which are adapted to be engaged with inward surfaces of the stationary guide rails 3 and 4. Assuming that the guide rail 6 is in the operative position and the guide rail 9 is in the retracted position, the guide rail 6 is moved apart from the rail 4 in the direction shown by an arrow a simultaneously descending as the crankshafts 11 and 14 are rotated to a position shown by dotted lines in FIG. 12 and upon further rotation of the crankshafts 11 and 14 it is moved in the direction shown by an arrow a' to a position directly beneath the original position. At the same time, the guide rail 9 is moved from the retracted position in the direction shown by an arrow b simultaneously ascending to the intermediate position shown by dotted lines in FIG. 12 and from there in the direction shown by an arrow b' to the operative position which is directly above the original position.

In FIG. 12, it will be noted that the guide surface has a radius of curvature Ra at the junction between the stationary guide rails 4 and 4*a* so that the end 6*a* of the movable guide rail 6 is formed with a corresponding curvature. At the junction between the stationary guide rails 3 and 3*a*, there is also formed with a guide surface having a radius of curvature Rb which is substantially coaxial with the guide surface at the junction between the guide rails 4 and 4*b*.

Referring further to FIG. 12, it will be noted that the tapered surface on the end 6*a* has a maximum angle $\Delta$ with respect to a longitudinal axis $\theta$-$\theta'$ of the track. Therefore, it is only necessary to determine the angle $\gamma$ between the axis of either the crankshaft 11 or 14 and a line perpendicular to the axis $\theta$-$\theta'$ larger than the angle $\Delta$ in order to avoid interference between the movable and stationary guide rails.

The invention has thus been shown and described with reference to a specific embodiment, however, it should be noted that the invention is in no way limited to the details of the illustrated structures but changes and modifications may be made without departing from the scope of the appended claims. For example, in the embodiment described above, the guide rails 3*a* and 5 are axially aligned with the guide rails 3 and 4 to provide a straight track and the guide rails 4*a* and 7 are curved to provide a leftwardly divided track. However, the arrangement may be such that the guide rails 7 and 4*a* are axially aligned with the guide rails 3 and 4 to provide a straight path and the guide rails 3*a* and 5 are in turn curved. Alternatively, the present invention can also be applied to an arrangement as shown by FIG. 13 A or B. In such an instance, the movable guide rails 6' and 9' or 6'' and 9'' may be actuated in a similar way as previously described.

We claim:

1. Track means for guideway vehicles comprising running surface means adapted for having load bearing wheels of the vehicle to run thereon, and guide rail means provided at the opposite sides of and extending along the running surface means, said running surface means including a first running surface section and at least second and third running surface sections which are separated from each other and connected with said first section through an intermediate running surface section, said guide rail means including first, second and third stationary guide rail sections respectively at the opposite sides of the first, second and third running surface sections, and switching means provided in the intermediate running surface section and including at least first and second guide rail segments for connecting said first stationary guide rail section respectively with said second and third stationary guide rail sections, said first and second guide rail segments being retractable beneath the intermediate running surface section, crankshaft means extending transversely with respect to said first and second guide rail segments and having crankarms extending in diametrically opposite directions, one of said crankarms being connected with said first guide rail segment and the other with said second guide rail segment, drive means for rotating said crankshaft means so that said first and second guide rail segments are alternately brought into operative positions wherein they project beyond the intermediate running surface section so as to alternately provide guide surfaces between said first stationary guide rail section and said second and third stationary guide rail sections, said crankshaft means comprising a pair of parallel crankshafts each having said diametrically oppositely extending crankarms, said crankshafts being further provided with third crankarms which are substantially perpendicular to said diametrically oppositely extending crankarms and connected together by a link, one of said crankshafts being connected through torsionally deflectable coupling means with said drive means, stopper means being provided for restricting rotation of said crankshafts to thereby prevent the first and second guide rail segments from being moved beyond the operative positions.

2. Track means in accordance with claim 1 in which said drive means includes overcenter locking means.

3. Track means in accordance with claim 2 in which said overcenter locking means includes a slotted arm having a slot therein and provided on one of said crankshaft and a motor shaft, and a further arm having a roller engaged with said slot in the slotted arm and provided on the other of said crankshaft and the motor shaft, said motor shaft being movable beyond a position wherein the slotted arm is perpendicular to said further arm.

4. Track means in accordance with claim 1 in which said perpendicular crankarm on the crankshaft that is connected with the drive means is longer than the perpendicular crankarm on the other crankshaft and said link is of a bent configuration so as to provide a longitudinal flexibility.

5. Track means in accordance with claim 1 in which one of the crankshafts is mounted through bracket means swingable about an axis parallel with said crankshaft.

6. Track means in accordance with claim 1 in which said guide rail segments have ends adapted for engagement with said guide rail sections, each of said guide rail segments being tapered with an angle with respect to a longitudinal line of said guide rail segments, said crankshaft means being arranged to extend in a direction having an angle larger than the first mentioned angles with respect to a line perpendicular to said guide rail section so that any interference between the guide rail segments and the guide rail sections is avoided.

* * * * *